US012305123B2

(12) United States Patent
Dreyer et al.

(10) Patent No.: US 12,305,123 B2
(45) Date of Patent: May 20, 2025

(54) HYDROGEN SULFIDE SCAVENGERS

(71) Applicant: ECOLAB USA INC., St. Paul, MN (US)

(72) Inventors: Daniel Robert Dreyer, Rosenberg, TX (US); Elizabeth Balapitiya, Missouri City, TX (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 17/571,229

(22) Filed: Jan. 7, 2022

(65) Prior Publication Data

US 2022/0220388 A1 Jul. 14, 2022

Related U.S. Application Data

(60) Provisional application No. 63/136,817, filed on Jan. 13, 2021.

(51) Int. Cl.
*C10C 3/08* (2006.01)
*C10G 21/14* (2006.01)

(52) U.S. Cl.
CPC ..... *C10C 3/08* (2013.01); *C10G 21/14* (2013.01); *C10G 2300/207* (2013.01)

(58) Field of Classification Search
CPC ..... C10G 21/14; C10G 29/04; C10G 29/20; C10G 2300/207; C10C 3/08
See application file for complete search history.

(56) References Cited

U.S. PATENT DOCUMENTS 4,987,186 A 1/1991 Akiyama et al.
4,987,228 A 1/1991 Cantatore et al.
5,000,835 A 3/1991 Taylor et al.
5,213,680 A 5/1993 Kremer et al.
5,314,672 A 5/1994 Vasil
5,618,882 A * 4/1997 Hammond ..... C08K 5/0016 524/508
7,264,786 B2 9/2007 Pakulski et al.
7,438,877 B2 10/2008 Salma et al.
7,495,045 B2 2/2009 Buras et al.
7,645,820 B2 1/2010 Buras et al.
7,713,345 B2 5/2010 Maldonado et al.
(Continued)

FOREIGN PATENT DOCUMENTS

AR 059003 3/2008
CN 102618202 8/2012
(Continued)

OTHER PUBLICATIONS

Ethylene Propylene Rubbers (Year: 2003).*
(Continued)

*Primary Examiner* — Prem C Singh
*Assistant Examiner* — Brandi M Doyle
(74) *Attorney, Agent, or Firm* — Eric D. Babych; Barnes & Thornburg LLP

(57) ABSTRACT

Scavenging compounds and compositions useful for scavenging hydrogen sulfide from streams are disclosed. The scavenging compositions may include a suspension of a metal component, a carrier solvent, and a polymer comprising styrene, propylene and ethylene. The streams may include asphalt, crude oil, naphtha, liquefied petroleum gas, vacuum gas oil, fuel oil, atmospheric tower bottoms, bitumen, and any combination of these streams.

20 Claims, 2 Drawing Sheets

(56) References Cited

U.S. PATENT DOCUMENTS

| | | | |
|---|---|---|---|
| 8,153,705 | B2 | 4/2012 | Gillard et al. |
| 8,202,922 | B2 | 6/2012 | Bolel et al. |
| 8,211,294 | B1 | 7/2012 | Zaid et al. |
| 8,241,491 | B1 | 8/2012 | Zaid et al. |
| 8,246,813 | B2 | 8/2012 | Compton et al. |
| 8,734,637 | B2 | 5/2014 | Taylor |
| 9,150,707 | B2 | 10/2015 | Schroeder |
| 9,610,535 | B2 | 4/2017 | Boday et al. |
| 9,932,478 | B2 | 4/2018 | Mouazen et al. |
| 2005/0153846 | A1 | 7/2005 | Gatlin |
| 2005/0238556 | A1 | 10/2005 | Pakulski et al. |
| 2006/0116450 | A1 | 6/2006 | Buras |
| 2008/0090945 | A1 | 4/2008 | Langrick et al. |
| 2009/0097881 | A1 | 4/2009 | Kondoh et al. |
| 2009/0145330 | A1 | 6/2009 | Draper et al. |
| 2009/0149577 | A1 | 6/2009 | Butler et al. |
| 2009/0206003 | A1 | 8/2009 | Draper |
| 2011/0022055 | A1 | 1/2011 | Quintin et al. |
| 2011/0160355 | A1 | 6/2011 | Martin |
| 2011/0306729 | A1 | 12/2011 | Dreessen et al. |
| 2012/0017503 | A1 | 1/2012 | Riggs et al. |
| 2014/0171721 | A1 | 6/2014 | Bertrand, III |
| 2014/0209304 | A1 | 7/2014 | Reed et al. |
| 2015/0360173 | A1 | 2/2015 | Boday et al. |
| 2015/0104579 | A1 | 4/2015 | Hedrick et al. |
| 2015/0218342 | A1 | 8/2015 | Martin |
| 2016/0289450 | A1 | 10/2016 | Mouazen et al. |
| 2017/0015811 | A1 | 1/2017 | Martin et al. |
| 2017/0022109 | A1 | 1/2017 | Poland et al. |
| 2017/0260095 | A1 | 9/2017 | Song et al. |
| 2017/0306129 | A1 | 9/2017 | Song et al. |
| 2018/0100096 | A1 | 4/2018 | Wylde |
| 2018/0163021 | A1 | 6/2018 | Tong et al. |
| 2018/0163050 | A1 | 6/2018 | Mouazen et al. |
| 2019/0055704 | A1* | 2/2019 | Fasula ..... C09J 193/04 |

FOREIGN PATENT DOCUMENTS

| | | | |
|---|---|---|---|
| CN | 104031355 | | 9/2014 |
| CN | 105073943 | B | 9/2018 |
| EP | 0636675 | A2 | 2/1955 |
| EP | 0121377 | A1 | 10/1984 |
| EP | 1699876 | * | 7/2009 |
| EP | 2262856 | | 12/2010 |
| EP | 3121231 | | 1/2017 |
| EP | 3710436 | A1 | 9/2020 |
| GB | 2306171 | | 4/1997 |
| KR | 1462545 | | 11/2014 |
| WO | WO 1992/001481 | A1 | 2/1992 |
| WO | WO 1999/058600 | A1 | 11/1999 |
| WO | WO 2015/007115 | A1 | 5/2015 |
| WO | WO 2015/116864 | A1 | 8/2015 |
| WO | WO 2015/123329 | A1 | 8/2015 |
| WO | 2016191672 | A1 | 12/2016 |
| WO | WO 2017/120430 | A1 | 7/2017 |
| WO | WO 2018/122680 | A1 | 7/2018 |

OTHER PUBLICATIONS

International Search Report and Written Opinion for International Application No. PCT/US 2022/039051, mailed Oct. 27, 2022.

Fan Zhang et al., "Performance and theoretical study on corrosion inhibition of 2-(4-pyridyl)-benzimidazole for mild steel in hydrochloric acid", Corrosion Science, vol. 61, (Aug. 2012), pp. 1-9.

Anonymous. "The Use and Performance of Asphalt Binder Modified with Polyphosphoric Acid (PPA)," TechBrief FHWA-HIF-12-030, Mar. 2012, 7 pages.

April, et al. "Polyphosphoric Acid Modification of Asphalt Binders, A Workshop," Apr. 7-8, 2009, Minneapolis, MN, Transportation Research Circular E-C160. URL: http://onlinepubs.trb.org/onlinepubs/circulars/ec160.pdf, retrieved from Internet on Mar. 4, 2015, 174 pages.

Bakke, et al. "Hydrolysis of 1,3,5-Tris(2-hydroxyethyl) hexahydro-s-triazine and Its Reaction with H 2 S," Industrial & Engineering Chemistry Research, 40(26), (2001), pp. 6051-6054.

International Preliminary Report on Patentability, PCT/US2020/019866, issued Aug. 25, 2021, 16 pages.

International Search Report and Written Opinion for related International Application No. PCT/US2015/015461, mailed May 22, 2015 (8 pages).

International Search Report and Written Opinion for related International Application No. PCT/US2017/063760, mailed Feb. 23, 2018 (14 pages).

Kodrat, et al. "Comparison of Polyphosphoric Acid-Modified Asphalt Binders with Straight and Polymer-Modified Materials," Transportation Research Record 1998(1), (2007), pp. 47-55.

Lin et al. "Performance characteristics of Terminal Blend rubberized asphalt with SBS and polyphosphoric acid," Construction and Building Materials, 141, (2017), pp. 171-182.

Liu et al. "Laboratory performance of warm mix asphalt binder containing polyphosphoric acid," Construction and Building Materials, 106, (2016), pp. 218-227.

Pankralov, V.A., et al., "Polytriazines," Russian Chemical Reviews, 41(1), pp. 66-82 (1972).

Platonov, V.A. "Properties of Polyphosphoric Acid," Fibre Chemistry, 32(5), (2000), pp. 325-329.

Polacco, et al. "A review of the fundamentals of polymer-modified asphalts: Asphalt/polymer interactions and principles of compatibility," Advances in Colloid and Interface Science, 224, (2015), pp. 72-112.

Zhang, et al. "The research for SPS and SBR compound modified asphalts with polyphosphoric acid and sulfur," Construction and Building Materials, 43, (2013), pp. 461-468.

* cited by examiner

HYDROGEN SULFIDE SCAVENGERS

TECHNICAL FIELD

The present disclosure relates generally to scavengers of sulfur-based species, and more particularly to compounds that scavenge hydrogen sulfide and/or mercaptan vapors.

BACKGROUND

Asphalt, alternatively referred to as bitumen, is commonly used in the paving of roads, roofing, and other similar construction applications. When paving roads, asphalt is often mixed with aggregate material, such as sand, gravel, or crushed stone. The asphalt (or bitumen) coats the aggregate material to give the asphalt, which may be spread as a uniform layer upon a road bed and compacted and smoothed with heavy rolling equipment.

Asphalt invariably contains sulfur. The amount of sulfur will depend on the origin of the crude oil, as well as the processes used to refine the crude oil, into asphalt. The sulfur may exist in different forms. For example, sulfur may be in the form of hydrogen sulfide. Hydrogen sulfide, or dihydrogen sulfide, is a chemical compound with the formula $H_2S$. It is a colorless, poisonous, flammable gas with the characteristically regarded foul odor.

Hydrogen sulfide may be released from asphalt, in particular when the asphalt is heated to a certain temperature and/or treated with various additives, such as polyphosphoric acid. For example, hydrogen sulfide results from the dehydrogenation reactions that occur between bitumen and sulfur at the hot mixing temperatures, for example temperatures greater than 140° C. Hydrogen sulfide emissions are regulated. Therefore, there exists a need to reduce the amount of hydrogen sulfide in asphalt.

A variety of polymers are used to treat/modify asphalt. The degree to which a polymer improves an asphalt's properties depends on the compatibility of the polymer and the asphalt; e.g., a polymer that does not separate in a mixture of asphalt and polymer during storage. Highly compatible or compatibilized polymers are more effective in providing property improvements. An extensive range of additives has been used for the purpose of "crosslinking" polymers and asphalts, thereby rendering the mixture compatible. For example, sulfur is a well-known crosslinking agent.

Polyphosphoric acid (PPA) ($H_{n+2}P_nO_{3n+1}$) is a polymer of orthophosphoric acid ($H_3PO_4$). PPA offered commercially is a mixture of orthophosphoric acid with pyrophosphoric acid, triphosphoric and higher acids. Superphosphoric acid is a similar mixture sold at 105% $H_3PO_4$. Other grades of phosphoric acid may contain water, but are not typically used in asphalt modification. This eliminates issues of foaming and corrosion at the refinery or terminal. PPA's major applications are surfactant production, water treatment, pharmaceutical synthesis, pigment production, flame proofing, metals finishing and asphalt modification.

PPA has been widely used in refineries to modify the performance properties of asphalt. Due to its strong acidity, however, the PPA would revert most $H_2S$ scavengers and allow undesirable release the hydrogen sulfide from scavenger treated asphalt.

BRIEF SUMMARY

The present disclosure relates generally to scavengers of sulfur-based species and methods of using the scavengers. In some embodiments, the disclosure provides a composition for scavenging hydrogen sulfide from a stream. The composition comprises a suspension of a metal component, a carrier solvent, and a polymer comprising styrene, propylene and ethylene.

In some embodiments, the stream is selected from the group consisting of asphalt, crude oil, naphtha, liquefied petroleum gas, vacuum gas oil, fuel oil, atmospheric tower bottoms, bitumen, and any combination thereof.

In some embodiments, the metal component comprises a metal oxide, a metal carbonate, a metal hydroxide, a metal alkoxide, and any combination thereof. In some embodiments, the metal comprises copper, zinc, iron, and any combination thereof. In some embodiments, the composition comprises from about 10 wt. % to about 70 wt. % of the metal component.

In some embodiments, the carrier solvent comprises a hydrocarbon solvent. In some embodiments, the composition comprises from about 30 wt. % to about 90 wt. % of the carrier solvent.

In some embodiments, the polymer further comprises a monomer selected from isoprene, isobutylene, butadiene, and any combination thereof. In some embodiments, the composition comprises from about 0.1 wt. % to about 10 wt. % of the polymer.

In some embodiments, the composition comprises a metal carboxylate. In certain embodiments, the metal carboxylate is a soluble metal carboxylate. In some embodiments, the metal carboxylate is selected from the group consisting of zinc carboxylate, iron carboxylate, copper carboxylate, and any combination thereof. In some embodiments, the composition comprises from about 0.5 wt. % to about 30 wt. % of the metal carboxylate.

In some embodiments, the composition further comprises a surfactant. In some embodiments, the composition comprises from about 0.1 wt. % to about 10 wt. % of the surfactant.

In some embodiments, the composition further comprises asphalt. In some embodiments, the asphalt comprises a treatment polymer. In some embodiments, the asphalt comprises about 0.1 wt. % to about 25 wt. % of the treatment polymer. In some embodiments, the treatment polymer comprises polyphosphoric acid.

In some embodiments, the composition is anhydrous or substantially free of water.

The present disclosure also provides methods of scavenging hydrogen sulfide from one or more streams. In some embodiments, a method comprises adding a composition to the stream, the composition comprising a suspension of a metal component, a carrier solvent, and a polymer comprising styrene, propylene and ethylene.

In some embodiments, the stream is selected from the group consisting of asphalt, crude oil, naphtha, liquefied petroleum gas, vacuum gas oil, fuel oil, atmospheric tower bottoms, bitumen, and any combination thereof.

In some embodiments, the metal component comprises a metal oxide, a metal carbonate, a metal hydroxide, a metal alkoxide, and any combination thereof. In some embodiments, the metal comprises copper, zinc, iron, and any combination thereof. In some embodiments, the composition comprises from about 10 wt. % to about 70 wt. % of the metal component.

In some embodiments, the carrier solvent comprises a hydrocarbon solvent. In some embodiments, the composition comprises from about 30 wt. % to about 90 wt. % of the carrier solvent.

In some embodiments, the polymer further comprises a monomer selected from isoprene, isobutylene, butadiene, and any combination thereof. In some embodiments, the composition comprises from about 0.1 wt. % to about 10 wt. % of the polymer.

In some embodiments, a method further comprises adding a metal carboxylate to the stream. In certain embodiments, the metal carboxylate is a soluble metal carboxylate. The metal carboxylate may be added before, after, and/or with the composition. In some embodiments, the metal carboxylate is selected from the group consisting of zinc carboxylate, iron carboxylate, copper carboxylate, and any combination thereof. In some embodiments, the composition comprises from about 0.5 wt. % to about 30 wt. % of the metal carboxylate.

In some embodiments, a method further comprises adding a surfactant to the stream. The surfactant may be added before, after, and/or with the composition. In some embodiments, the composition comprises from about 0.1 wt. % to about 10 wt. % of the surfactant.

In some embodiments, the stream comprises asphalt. In some embodiments, a treatment polymer is added to the asphalt. In some embodiments, the asphalt comprises about 0.1 wt. % to about 25 wt. % of the treatment polymer. In some embodiments, the treatment polymer comprises polyphosphoric acid.

The present disclosure also provides for the use of any composition disclosed herein in a method of scavenging hydrogen sulfide, such as reducing hydrogen sulfide emission from asphalt.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
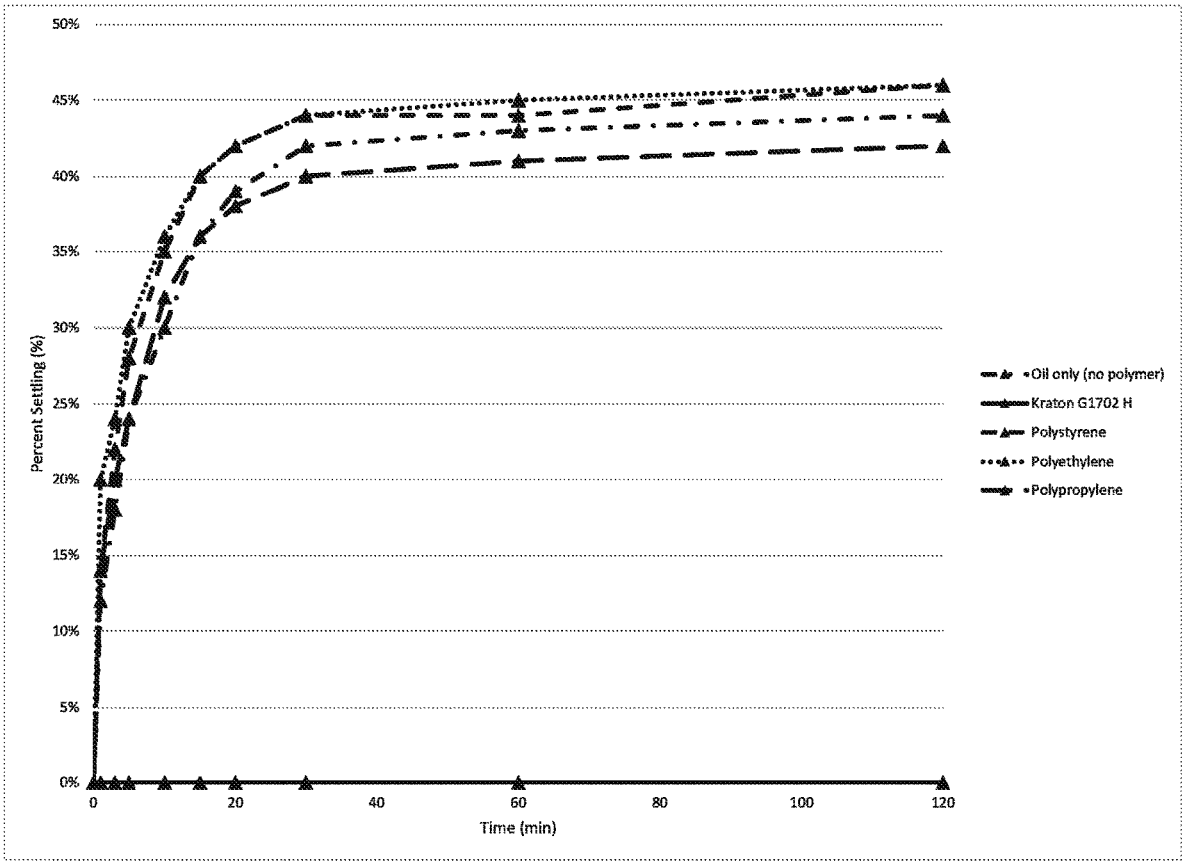
FIGS. 1 and 2 depict the results from settling experiments, which were conducted to show the utility of the presently claimed invention.

The present disclosure relates to sulfide-scavenging compositions and methods of scavenging sulfides using the compositions. The compositions can be used to scavenge hydrogen sulfide from various streams. Illustrative, non-limiting examples of streams include asphalt, crude oil, naphtha, liquefied petroleum gas, vacuum gas oil, fuel oil, atmospheric tower bottoms, bitumen, and any combination thereof. In accordance with the present disclosure, a sulfide-scavenging composition or a scavenger is a composition capable of, for example, lowering/reducing an amount of hydrogen sulfide in a stream.

In some embodiments, the compositions are highly efficient at reducing hydrogen sulfide emissions of asphalt, including polymer-treated asphalt, such as PPA-treated asphalt.

In accordance with the present disclosure, the term "alkyl" as used herein, refers to a hydrocarbon radical with a defined number of carbon atoms (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 carbons). Branched alkyl groups include, but are not limited to, 2-ethylhexyl, octyl, sec-butyl, tert-butyl, isobutyl, isopentyl, neopentyl, 1-methylbutyl, 2-methylbutyl, 1,1-dimethylpropyl, 1,2-dimethylpropyl, 1-ethylpropyl, 1-methylpentyl, 2-methylpentyl, 3-methylpentyl, 4-methylpentyl, 1,1-dimethylbutyl, 1,2-dimethylbutyl, 1,3-dimethylbutyl, 2,2-dimethylbutyl, 2,3-dimethylbutyl, 3,3-dimethylbutyl, 1,1,2-trimethylpropyl, 1,2,2-trimethylpropyl, 1-ethylbutyl, 2-ethylbutyl, 1-methylhexyl, 2-methylhexyl, 3-methylhexyl, 4-methylhexyl, 5-methylhexyl, 1,1-dimethylpentyl, 1,2-dimethylpentyl, 1,3-dimethylpentyl, 1,4-dimethylpentyl, 2,2-dimethylpentyl, 2,3-dimethylpentyl, 2,4-dimethylpentyl, 3,3-dimethylpentyl, 3,4-dimethylpentyl, 4,4-dimethylpentyl, 1,1,2-trimethylbutyl, 1,1,3-trimethylbutyl, 1,2,2-trimethylbutyl, 1,2,3-trimethylbutyl, 1,3,3-trimethylbutyl, 2,2,3-trimethylbutyl, 2,3,3-trimethylbutyl, 1,1,2,2-tetramethylpropyl, 1-ethylpentyl, 2-ethylpentyl, 3-ethylpentyl, 1-ethyl-1-methylbutyl, 1-ethyl-2-methylbutyl, 1-ethyl-3-methylbutyl, 2-ethyl-1-methylbutyl, 2-ethyl-2-methylbutyl, 2-ethyl-3-methylbutyl, 1-propylbutyl, 1,1-diethylpropyl, etc.

In some embodiments, the number of carbon atoms for the alkyl group is between 6 and 30. In some embodiments, the number of carbon atoms for the alkyl group is between 6 and 20. In some embodiments, the number of carbon atoms for the alkyl group is between 6 and 15. In some embodiments, the number of carbon atoms for the alkyl group is between 6 and 10. In some embodiments, the number of carbon atoms for the alkyl group is between 6 and 8.

The term "alkoxyl" as used herein, refers to a ether radical with a defined number of carbon atoms (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 carbons). Branched alkyl groups include, but are not limited to, sec-butoxy, tert-butoxy, isobutoxy, isopentoxy, neopentoxy, 1-methylbutoxy, 2-methoxybutoxy, 1,1-dimethylpropoxy, 1,2-dimethylpropoxy, 1-ethylpropoxy, 1-methylpentoxy, 2-methylpentoxy, 3-methylpentoxy, 4-methylpentoxy, 1,1-dimethylbutoxy, 1,2-dimethylbutoxy, 1,3-dimethylbutoxy, 2,2-dimethylbutoxy, 2,3-dimethylbutoxy, 3,3-dimethylbutoxy, 1,1,2-trimethylpropoxy, 1,2,2-trimethylpropoxy, 1-ethylbutoxy, 2-ethylbutoxy, 1-methylhexoxy, 2-methylhexoxy, 3-methylhexoxy, 4-methylhexoxy, 5-methylhexoxy, 1,1-dimethylpentoxy, 1,2-dimethylpentoxy, 1,3-dimethylpentoxy, 1,4-dimethylpentoxy, 2,2-dimethylpentoxy, 2,3-dimethylpentoxy, 2,4-dimethylpentoxy, 3,3-dimethylpentoxy, 3,4-dimethylpentoxy, 4,4-dimethylpentoxy, 1,1,2-trimethylbutoxy, 1,1,3-trimethylbutoxy, 1,2,2-trimethylbutoxy, 1,2,3-trimethylbutoxy, 1,3,3-trimethylbutoxy, 2,2,3-trimethylbutoxy, 2,3,3-trimethylbutoxy, 1,1,2,2-tetramethylpropoxy, 1-ethylpentoxy, 2-ethylpentoxy, 3-ethylpentoxy, 1-ethyl-1-methylbutoxy, 1-ethyl-2-methylbutoxy, 1-ethyl-3-methylbutoxy, 2-ethyl-1-methylbutoxy, 2-ethyl-2-methylbutoxy, 2-ethyl-3-methylbutoxy, 1-propylbutoxy, 1,1-diethylpropoxy, etc.

In some embodiments, the number of carbon atoms for the alkyl portion of the alkoxy group is between 6 and 30. In some embodiments, the number of carbon atoms for the alkyl group is between 6 and 20. In some embodiments, the number of carbon atoms for the alkyl group is between 6 and 15. In some embodiments, the number of carbon atoms for the alkyl group is between 6 and 10. In some embodiments, the number of carbon atoms for the alkyl group is between 6 and 8.

As used herein, the term "asphalt" refers to any of a variety of materials that are solid or semisolid at room temperature and which gradually liquefy when heated, and in which the predominant constituents are naturally occurring bitumens (or kerogens) or which are bitumen-like materials obtained as residue in petroleum refining. It is expressly contemplated that asphalt as used herein includes what ASTM defines as asphalt: a dark brown to black cementitious material in which the predominant constituents are bitumens that occur in nature or are obtained in petroleum processing. Asphalts characteristically contain very high molecular weight hydrocarbons called asphaltenes. These are essentially soluble in carbon disulfide, and aromatic and chlorinated hydrocarbons. Bitumen is a generic term defined by the ASTM as a class of black or dark-colored cementitious substances, natural or manufactured, composed principally of high molecular weight hydrocarbons, of which asphalts, tars, pitches and asphaltenes are typical. The ASTM further classifies asphalts or bituminous materials as solids, semi-solids, or liquids using a penetration test for consistency or viscosity. In this classification, solid materials are those having a penetration of not more than 1 millimeter when a load of 100 grams is applied for 5 seconds while at 25° C., and semi-solids are those having a penetration of more than 1 millimeter when a load of 50 grams is applied for 5 seconds while at 25° C. Semi-solid and liquid asphalts predominate in commercial practice today. For example, any asphalt bottoms fraction, as well as naturally occurring asphalts, tars and pitches and may be used interchangeably herein with the term "bitumen." The term "asphaltic concrete" means asphalt used as a binder with appropriate aggregate added, typically for use as a paving material.

The term "bottoms fraction" refers to a crude fraction having a flash point of about 70° F. or greater.

The term "anhydrous" as used herein, refers to compositions where the amount of water present is less than about 10 weight %, such as less than about 7 weight %, less than about 5 weight %, less than about 4 weight %, less than about 3 weight %, less than about 2 weight %, less than about 1 weight %, or about 0 weight %.

COMPOSITIONS

The compositions disclosed herein comprise a suspension of a metal component, a carrier solvent, and a polymer comprising styrene, propylene and ethylene. In some embodiments, the compositions comprise asphalt, which could be polymer-treated asphalt, such as PPA-treated asphalt. The compositions may further comprise a solvent and/or a surfactant. In some embodiments, the composition is anhydrous.

The suspension of the metal component is not particularly limited. In some embodiments, the metal component comprises a metal oxide, a metal carbonate, a metal hydroxide, a metal alkoxide, and any combination thereof. All oxidation states of the metal are also contemplated and covered by the term "oxide," such as CuO and $Cu_2O$.

The metal component comprises any combination of metals, such as copper, zinc or iron, with any combination of oxides, carbonates, hydroxides and alkoxides. The metal component may also comprise unrefined minerals that comprise desired metals, such as cuprite (copper oxide), malachite and azurite (which are copper carbonate minerals). For example, in some embodiments, the metal suspended in the carrier solvent may be from copper oxide.

Illustrative, non-limiting examples include iron oxides, iron carbonates, iron hydroxide, iron alkoxides, copper oxides, copper carbonates, copper hydroxide, copper alkoxides, zinc oxides, zinc carbonates, zinc hydroxide, and zinc alkoxides.

In some embodiments, the metal comprises a divalent ion selected from, but not limited to, Cu (II), Zn (II), Fe (II), Ni (II), Co (II), Mn (II), Ca (II), Mg (II), and any combination thereof.

In some embodiments, the metal component may comprise one or more metal oxides and one or more metal carbonates. In some embodiments, the metal component may comprise one or more metal oxides and one or more metal hydroxides. In some embodiments, the metal component may comprise one or more metal oxides and one or more metal alkoxides. In some embodiments, the metal component may comprise one or more metal carbonates and one or more metal hydroxides. In some embodiments, the metal component may comprise one or more metal carbonates and one or more metal alkoxides. In some embodiments, the metal component may comprise one or more metal hydroxides and one or more metal alkoxides.

In additional embodiments, the metal component may comprise one or more metal oxides, one or more metal carbonates, one or more metal hydroxides and one or more metal alkoxides. In some embodiments, the metal component may comprise one or more metal oxides, one or more metal carbonates and one or more metal hydroxides. In some embodiments, the metal component may comprise one or more metal oxides, one or more metal carbonates and one or more metal alkoxides. In some embodiments, the metal component may comprise one or more metal carbonates, one or more metal hydroxides and one or more metal alkoxides.

Further, the metal component may comprise one or more metal oxides, such as zinc oxide, copper oxide, iron oxide, and any combination thereof. In some embodiments, the metal component may comprise one or more metal carbonates, such as zinc carbonate, copper carbonate, iron carbonate, and any combination thereof. In some embodiments, the metal component may comprise one or more metal hydroxides, such as zinc hydroxide, copper hydroxide, iron hydroxide, and any combination thereof. In some embodiments, the metal component may comprise one or more metal alkoxides, such as a zinc alkoxide, a copper alkoxide, an iron alkoxide, and any combination thereof.

The amount of the metal component in the composition is not particularly limited. In some embodiments, the compositions comprise from about 10 wt. % to about 70 wt. % of the metal component. In some embodiments, the compositions comprise from about 20 wt. % to about 50 wt. % of the metal component. In certain embodiments, the compositions comprise from about 30 wt. % to about 40 wt. % of the metal component, such as about 35 wt. % of the metal component.

The compositions may optionally comprise carboxylates and/or carboxylates may be added to streams before, after and/or with the compositions.

The compositions may comprise any combination of metals, such as copper, zinc or iron, with any combination of carboxylates. The present disclosure covers all carboxylates, such as acetates, butyrates (including isomers thereof), hexanoates (including isomers thereof), octoates (including isomers thereof), glycinates, gluconates, benzoates, and oxalates. Mixtures of the carboxylates (e.g., acetate+octoate) are also covered by the present disclosure.

In some embodiments, the carboxylate comprises copper acetate, copper bis-glycinate, zinc acetate, zinc bis-glycinate, zinc 2-ethylhexanoate, copper 2-ethylhexanoate, iron 2-ethylhexanoate and any combination thereof. In some embodiments, the carboxylate comprises zinc octoate. In particular embodiments, the molar ratio of zinc complexed with octanoic acid is not 1:2. In some embodiments, the ratio is from about 2.1:3 to about 1.97:3 (see, for example, U.S. Pat. No. 8,246,813, the entire contents of which are incorporated into the present disclosure in their entirety).

In some embodiments, the metal component may comprise one or more metal carboxylates and one or more metal oxides. In some embodiments, the metal component may comprise one or more metal carboxylates, one or more metal oxides, and/or one or more metal carbonates. In some embodiments, the metal component may comprise one or more metal carboxylates, one or more metal oxides, one or more metal carbonates, and/or one or more metal hydroxides. In some embodiments, the metal component comprises one or more metal carboxylates, one or more metal oxides, one or more metal carbonates, one or more metal hydroxides and/or one or more metal alkoxides.

In accordance with the present disclosure, carboxylates may be derived from various carboxylic acids. In some embodiments, the carboxylic acids may comprise from 1 to about 20 carbon atoms. The carboxylic acids include various hydroxyl acids and amino acids, such as glycine, aspartic acid, citric acid, etc. In some embodiments, the carboxylic acid is selected from the group consisting of carbonic acid, methanoic acid, ethanoic acid, propanoic acid, butanoic acid, pentanoic acid, hexanoic acid, heptanoic acid, octanoic acid, 2-ethylhexanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, and any combination thereof.

In additional embodiments, the carboxylic acid is selected from branched neo-acids, such as neodecanoic acid. In some embodiments, the carboxylic acid is selected from an aromatic acid, such as benzoic acid and/or naphthoic acid, wherein the aromatic rings may include alkyl and alkoxy groups attached to them.

If a carboxylate is included in the suspension, the amount of carboxylate in the composition is not particularly limited. In some embodiments, the composition may comprise about 0.5 wt. % to about 30 wt. % of the carboxylate, such as about 25 wt. %. In some embodiments, the composition may comprise about 1 wt. % to about 20 wt. % of the carboxylate, such as about 15 wt. %. In some embodiments, the composition may comprise about 2 wt. % to about 10 wt. % of the carboxylate, such as about 5 wt. %.

The carrier solvent(s) included with the compositions disclosed herein are not particularly limited. In some embodiments, the carrier solvent is selected from the group consisting of paraffin oil, mineral oil, and a hydrocarbon solvent. The hydrocarbon solvent covers, for example, low aromatic hydrocarbon solvents. In some embodiments, the carrier excludes or does not comprise an aromatic solvent.

In some embodiments, a composition disclosed herein may include about 30 wt. % to about 90 wt. % of the carrier solvent, such as about 85 wt. %. In some embodiments, a composition disclosed herein may include about 50 wt. % to about 80 wt. % of the carrier solvent, such as about 75 wt. %. In some embodiments, a composition disclosed herein may include about 60 wt. % to about 70 wt. % of the carrier solvent, such as about 65 wt. %.

The compositions disclosed herein also include a polymer comprising styrene, propylene and ethylene. The polymer may comprise other monomers as well. In some embodiments, the monomers are randomly distributed throughout the polymer. In certain embodiments, the polymer may comprise a segment of alternating ethylene and propylene monomers. In some embodiments, one or both ends of the polymer may comprise segments of styrene monomers. The ratio of each monomer in the polymer is not particularly limited and may be selected by one of ordinary skill in the art. In some embodiments, the polymer comprises about 1 wt. % to about 50 wt. % styrene, about 1 wt. % to about 90 wt. % propylene, and about 1 wt. % to about 90 wt. % ethylene.

In some embodiments, the polymer comprises about 1 wt. % to about 40 wt. % styrene, about 1 wt. % to about 30 wt. % styrene, about 1 wt. % to about 20 wt. % styrene, about 1 wt. % to about 10 wt. % styrene, about 5 wt. % to about 15 wt. % styrene, or about 10 wt. % to about 12 wt. % styrene, such as about 11 wt. % styrene.

In some embodiments, the polymer comprises about 10 wt. % to about 80 wt. % ethylene, about 20 wt. % to about 70 wt. % ethylene, about 30 wt. % to about 60 wt. % ethylene, about 40 wt. % to about 50 wt. % ethylene, or about 40 wt. % to about 45 wt. % ethylene, such as about 43 wt. % ethylene.

In some embodiments, the polymer comprises about 10 wt. % to about 80 wt. % propylene, about 20 wt. % to about 70 wt. % propylene, about 30 wt. % to about 60 wt. % propylene, about 40 wt. % to about 50 wt. % propylene, or about 45 wt. % to about 50 wt. % propylene, such as about 46 wt. % propylene.

In addition to styrene, ethylene, and propylene, the polymer of the composition may comprise additional monomers. For example, the polymer may further comprise isoprene, isobutylene, butadiene, and any combination thereof.

In some embodiments, the polymer comprises a block copolymer. In other embodiments, the polymer comprises a random copolymer. In some embodiments, the polymer comprises a block copolymer and a random copolymer.

Further, the polymers disclosed herein may comprise any configuration. For example, the polymers may be linear, branched, star, and/or dendrimeric.

The compositions comprise from about 0.1 wt. % to about 10 wt. % of the polymer, such as about 7 wt. %. In some embodiments, a composition comprises about 1 wt. % to about 5 wt. % of the polymer, such as about 4 wt. %. In some embodiments, a composition comprises about 1.5 wt. % to about 3 wt. % of the polymer, such as about 2 wt. %.

The molecular weight of the polymer is not particularly limited and may be selected by one of ordinary skill in the art. In some embodiments, the weight average molecular weight is about 1,000 Da to about 1,000,000 Da, about 1,000 Da to about 750,000 Da, about 1,000 Da to about 500,000 Da, about 1,000 Da to about 300,000 Da, about 1,000 Da to about 200,000 Da, about 1,000 Da to about 150,000 Da, about 25,000 Da to about 200,000 Da, about 50,000 Da to about 200,000 Da, or about 100,000 Da to about 200,000 Da, such as about 150,500 Da.

The inventors discovered that the polymer disclosed herein provides unexpectedly superior results when used in combination with the other components of the compositions. For example, with prior art compositions including suspensions of metals, settling of the metals is a major concern. However, the settling time of the metals in the presently disclosed compositions is unexpectedly and substantially extended due to the polymer. The polymer was unexpectedly found to significantly slow or completely prevent settling of the metal component.

The asphalt disclosed herein may be, but does not need to be, polymer-treated asphalt. Depending upon the desired application of the asphalt, one or more treatment polymers may be added thereto to modify certain performance characteristics. The treatment polymers include, but are not limited to, various rubbers, thermoplastic elastomers, elastomeric polymers, and any combination thereof. Elastomeric polymers include synthetic and/or natural rubbers, such as, but not limited to, polybutadiene, ethylene/vinyl acetate copolymers, polyacrylates, styrene-butadiene copolymers, polyolefins, and styrene-isoprene copolymers. In some embodiments, the treatment polymers comprise conjugated diene units and/or aromatic monovinyl hydrocarbon units. In certain embodiments, the treatment polymer is PPA.

The treatment polymers may be crosslinked or may be free of crosslinks. One of ordinary skill in the art understands the types of agents that can be used to crosslink treatment polymers such as, but not limited to, organic sulfur-containing crosslinkers, elemental sulfur crosslinkers, etc.

The asphalt may comprise from about 0.1 weight % to about 25 weight % of the treatment polymer. In some embodiments, the asphalt comprises from about 0.1 weight % to about 15 weight % of the treatment polymer. In some embodiments, the asphalt comprises from about 0.1 weight % to about 10 weight % of the treatment polymer. In some embodiments, the asphalt comprises from about 0.1 weight % to about 5 weight % of the treatment polymer. In certain embodiments, the asphalt comprises about 1 weight % of the treatment polymer.

In accordance with certain embodiments of the present disclosure, PPA is added to the asphalt. Acid modification of the asphalt generally results in asphalt compositions that exhibit improved low temperature performance. The asphalt composition may include less than or equal to about 10 wt. % acid. In some embodiments, the asphalt composition includes less than or equal to about 5 wt. % acid. In some embodiments, the asphalt composition includes less than or equal to about 3 wt. % acid. In some embodiments, the asphalt composition includes less than or about 1 wt. % acid and may include from about 0.01 wt. % to about 1 wt. % acid, from about 0.05 wt. % to about 1 wt. % acid, or from about 0.1 wt. % to about 1 wt. % acid, for example.

The compositions disclosed herein can optionally include one or more additives. Suitable additives include, but are not limited to, asphaltene inhibitors, paraffin inhibitors, corrosion inhibitors, scale inhibitors, emulsifiers, water clarifiers, dispersants, emulsion breakers, gas hydrate inhibitors, biocides, pH modifiers, surfactants (including anionic surfactants, cationic surfactants and non-ionic surfactants), and combinations thereof.

The surfactant additive is not particularly limited and any appropriate surfactant may be selected. For example, the surfactant may be one selected from the Span or Tween family of surfactants. Triton, Pluronic, and Tergitol surfactants may also be used. The surfactant may be anionic, cationic, non-ionic, zwitterionic or amphoteric. The inventors discovered that the surfactant can help reduce or inhibit settling of the metal component.

The compositions may include from about 0.001 wt. % to about 10 wt. % of total additives. For example, a composition may include from about 0.01 wt. % to about 10 wt. % of total additives or from about 0.1 wt. % to about 10 wt. % of total additives. In some embodiments, a composition may include about 0.5 wt. % to about 5 wt. % of total additives. In certain embodiments, a composition may include about 1 wt. % to about 3 wt. % of total additives.

PREPARATION METHODS

In accordance with certain embodiments of the present disclosure, the compositions are made with anhydrous components. The compositions may be used with any streams, such as asphalt. Anhydrous components/compositions can facilitate handling of PPA-treated asphalt and asphalt mixtures at temperatures around 250° C. In some embodiments, the temperature of the asphalt or asphalt mixture is less than about 200° C. In some embodiments, the temperature of the asphalt or asphalt mixture is less than about 150° C. In some embodiments, the temperature of the asphalt or asphalt mixture is less than about 100° C. In some embodiments, the temperature of the asphalt or asphalt mixture is less than about 90° C.

Illustrative, non-limiting methods of forming such asphalt compositions are described below. For example, in one embodiment, asphalt is heated in a first mixing vessel to a temperature of from about 140° C. to 205° C. The asphalt concentrate may then be transferred to a second mixing vessel or remain in the first mixing vessel.

PPA (or any other treatment polymer contemplated herein) may be added to the mixing vessel. The treatment polymer is added in a timed-release manner sufficient to avoid foaming, such as from about 20 minutes to about 1 hour, for example. The treatment polymer, however, can be added at any point in the process and to any vessel or conduit in the process. For example, the treatment polymer can be added to a first or second mixing vessel or to a conduit operably connecting the first and second mixing vessels.

The sulfide-scavenging composition may then be added. An optional metal carboxylate may also be added. The composition may be added before, after, and/or with the optional carboxylate. An optional surfactant and/or other additive may also be added. The composition may be added before, after, and/or when the surfactant and/or other additive is added. The composition may be added before, after, and/or when the treatment polymer is added. The addition of the various components to the asphalt may occur with mixing for about 15 minutes to about 10 hours, for example.

The compounds, compositions, methods, and processes disclosed herein will be better understood by reference to the following examples, which are intended to be illustrative and not limit the scope of the present disclosure.

EXAMPLES

A variety of inventive and comparative compositions were tested. Formulation 1 was a composition comprising zinc oxide (about 21 wt. %) in a paraffinic hydrocarbon solvent (about 76 wt. %). Kraton™ G1702H (a styrenic block copolymer) (about 3 wt. %) was dissolved in the solvent and served as the suspension aid to mitigate settling of the zinc oxide.

Formulation 2 was similar to Formulation 1 but Formulation 2 included about 10 wt. % of zinc carboxylate, about 19 wt. % zinc oxide, about 3 wt. % Kraton™ G1702H, and about 68 wt. % of the paraffin oil. Formulation 2 showed moderately improved hydrogen sulfide scavenging performance as compared to Formulation 1. Without wishing to be bound by theory, Formulation 2 may have outperformed Formulation 1 due to the more favorable reactivity of dissolved zinc carboxylate with dissolved hydrogen sulfide as opposed to the biphasic reaction that must occur with heterogeneously dispersed zinc oxide.

Formulation 3 was a copper oxide (about 30 wt. %) suspension in a paraffinic hydrocarbon solvent (about 67 wt. %). Kraton™ G1702H (about 3 wt. %) was dissolved in the solvent. Formulation 4 was similar to Formulation 3 but Formulation 4 included about 1 wt. % of Span™ 80 (sorbitan monooleate, a non-ionic surfactant), about 30 wt. % of copper oxide, about 3 wt. % of Kraton™ G1702H and about 66 wt. % paraffin oil.

The Formulations were characterized across two general areas: hydrogen sulfide scavenging performance and stability (resistance to settling).

Formulation 1 was added to asphalt (not treated with a treatment polymer) in order to demonstrate its ability to scavenge hydrogen sulfide. The results of the test are shown in Table 1. At a reaction ratio of about 0.67, the hydrogen sulfide content was reduced by about 78% and at a reaction ratio of about 1, the hydrogen sulfide content was reduced by about 94%.

TABLE 1

| Treatment | Reaction Ratio | Dosage in 500 mL Asphalt | $H_2S$ Level | % Reduction |
|---|---|---|---|---|
| BLANK | — | — | 1800 ppm | — |
| Formulation 1 | 0.33 | 300 μL | 650 ppm | 64% |
| Formulation 1 | 0.67 | 600 μL | 400 ppm | 78% |
| Formulation 1 | 1.00 | 900 μL | 100 ppm | 94% |

Formulation 2 was added to asphalt (not treated with a treatment polymer) in order to demonstrate its ability to scavenge hydrogen sulfide. The results of the test are shown in Table 2. At a reaction ratio of about 0.6, the hydrogen sulfide content was reduced by about 80% and at a reaction ratio of about 0.8, the hydrogen sulfide content was reduced by about 85%. Compared to the results shown in Table 1, the reduction of hydrogen sulfide was slightly higher. These results indicate that there can be a moderate advantage to incorporating soluble zinc carboxylates (or other soluble zinc species or metal carboxylate) into the suspension. The benefit may be more pronounced at lower reaction ratios, such as 0.2-0.4.

TABLE 2

| Treatment | Reaction Ratio | Dosage in 500 mL Asphalt | $H_2S$ Level | % Reduction |
|---|---|---|---|---|
| BLANK | — | — | 600 ppm | — |
| Formulation 2 | 0.2 | 60 μL | 180 ppm | 70% |
| Formulation 2 | 0.4 | 120 μL | 140 ppm | 77% |
| Formulation 2 | 0.6 | 180 μL | 120 ppm | 80% |
| Formulation 2 | 0.8 | 240 μL | 90 ppm | 85% |

The presently disclosed compositions are also very effective at scavenging hydrogen sulfide in PPA-treated asphalt. A representative example is shown in Table 3. In the absence of PPA, a vapor phase hydrogen sulfide level of 2000 ppm was measured. After treatment with 0.5% PPA, a significant increase to 7500 ppm was measured. After treatment with Formulation 3, significantly reduced levels of hydrogen sulfide were measured. At a reaction ratio of 0.2, the hydrogen sulfide concentration was reduced by 89% and at a reaction ratio of 0.3, the hydrogen sulfide concentration was reduced by 97%.

TABLE 3

| Treatment | Reaction Ratio | Dosage Conc. | Dosage in 500 mL Asphalt | $H_2S$ Level | % Reduction |
|---|---|---|---|---|---|
| BLANK | Blank (w/out PPA) | — | — | 2000 ppm | — |
| BLANK | Blank (w/PPA) | — | 60 μL | 7500 ppm | — |
| Formulation 3 ppm | 0.2 | 1500 | 120 μL | 800 ppm | 89% |
| Formulation 3 ppm | 0.3 | 2250 | 180 μL | 200 ppm | 97% |
| Formulation 3 ppm | 0.4 | 3000 | 240 μL | 150 ppm | 98% |

Additional experiments were conducted to prove the unexpected superiority of the presently disclosed polymer. Five suspensions were prepared, each being placed in a separate jar and having the same carrier solvent (paraffin oil) and metal component (copper oxide). Each suspension had about 2.4 wt. % of a different polymer component as follows:

Suspension 1: No polymer component
Suspension 2: Kraton™ G1702H
Suspension 3: Polystyrene homopolymer
Suspension 4: Polyethylene homopolymer
Suspension 5: Polypropylene homopolymer All samples were shaken vigorously, placed on a benchtop, and monitored over a period of time. As can be seen in FIG. 1, Suspension 2 did not experience any settling. All other suspensions had over 40% settling within the first 30 minutes. Over 100 hours later, Suspension 2 still did not experience any settling. Percent settling is defined as the height of the oil layer (supernatant)/the total sample height.

Additional experiments were conducted to prove the unexpected superiority of the presently disclosed polymer. Nine suspensions were prepared, each being placed in a separate jar and having the same carrier solvent (paraffin oil). Various metal components were tested as shown below. Each suspension had about 2.4 wt. % of a different polymer component as follows:

Suspension 6: Oil only/No polymer/CuO
Suspension 7: Kraton™ G1702H/CuO
Suspension 8: Kraton™ G1702H/ZnO
Suspension 9: Kraton™ G1702H/$Cu_2(OH)_2CO_3$
Suspension 10: Kraton™ G1702H/$Fe_2O_3$
Suspension 11: SEBS/CuO
Suspension 12: SEBS/$Cu_2(OH)_2CO_3$
Suspension 13: SBS/ZnO
Suspension 14: SBS/$Fe_2O_3$ SEBS is an abbreviation for polystyrene-block-poly(ethylene-random-butylene)-block-polystyrene and SBS is an abbreviation for polystyrene-block-polybutadiene-block-polystyrene.

Figure 2:
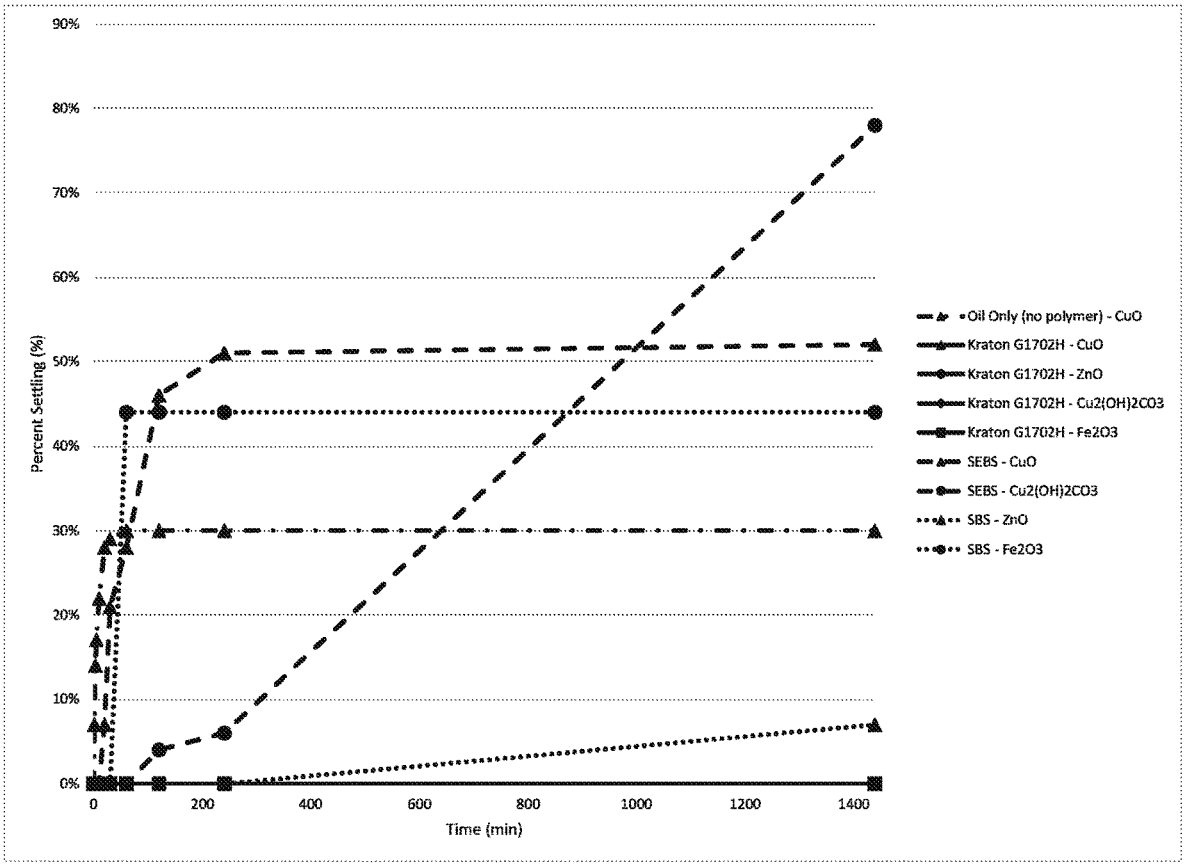

As can be seen in FIG. 2, after about 300 minutes, none of the suspensions comprising Kraton™ G1702H experienced any settling while all other samples began to experience some degree of settling. Even after about 1,500 minutes, none of the suspensions comprising Kraton™ G1702H experienced any settling.

The results surprisingly and unexpectedly show that there was not any settling in the suspensions comprising the polymer component falling under the scope of the claims. All other suspensions having polymer components that do not fall under the scope of the claims experienced significant settling. These results show that adequate suspension cannot be replicated with simply any polymer component, even if the polymer component is somewhat similar to the inventive polymer component of the present application.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a polymer" is intended to include "at least one polymer" or "one or more polymers."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Any composition disclosed herein may comprise, consist of, or consist essentially of any element, component and/or ingredient disclosed herein or any combination of two or more of the elements, components or ingredients disclosed herein.

Any method disclosed herein may comprise, consist of, or consist essentially of any method step disclosed herein or any combination of two or more of the method steps disclosed herein.

The transitional phrase "comprising," which is synonymous with "including," "containing," or "characterized by," is inclusive or open-ended and does not exclude additional, un-recited elements, components, ingredients and/or method steps.

The transitional phrase "consisting of" excludes any element, component, ingredient, and/or method step not specified in the claim.

The transitional phrase "consisting essentially of" limits the scope of a claim to the specified elements, components, ingredients and/or steps, as well as those that do not materially affect the basic and novel characteristic(s) of the claimed invention.

Unless specified otherwise, all molecular weights referred to herein are weight average molecular weights and all viscosities were measured at 25° C. with neat (not diluted) polymers.

As used herein, the term "about" refers to the cited value being within the errors arising from the standard deviation found in their respective testing measurements, and if those errors cannot be determined, then "about" may refer to, for example, within 5% of the cited value.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A composition for scavenging hydrogen sulfide from a stream, comprising:

(a) a suspension of a metal component;

(b) a carrier solvent; and (c) a polymer comprising styrene, propylene and ethylene; wherein the polymer comprises about 1 wt. % to about 90 wt. % of the ethylene; and wherein the composition comprises from about 10 wt. % to about 70 wt. % of the metal component.

2. The composition of claim 1, wherein the stream is selected from the group consisting of asphalt, crude oil, naphtha, liquefied petroleum gas, vacuum gas oil, fuel oil, atmospheric tower bottoms, bitumen, and any combination thereof.

3. The composition of claim 1, wherein the metal component comprises a metal oxide, a metal carbonate, a metal hydroxide, a metal alkoxide, and any combination thereof.

4. The composition of claim 1, wherein the metal comprises copper, zinc, iron, and any combination thereof.

5. The composition of claim 1, wherein the carrier solvent comprises a hydrocarbon solvent.

6. The composition of claim 1, wherein the composition comprises from about 30 wt. % to about 90 wt. % of the carrier solvent.

7. The composition of claim 1, wherein the polymer further comprises a monomer selected from isoprene, isobutylene, butadiene, and any combination thereof.

8. The composition of claim 1, wherein the composition comprises from about 0.1 wt. % to about 10 wt. % of the polymer.

9. The composition of claim 1, further comprising a metal carboxylate.

10. The composition of claim 9, wherein the composition comprises from about 0.5 wt. % to about 30 wt. % of the metal carboxylate.

11. The composition of claim 1, further comprising a surfactant.

12. The composition of claim 1, further comprising asphalt.

13. The composition of claim 12, further comprising a treatment polymer.

14. The composition of claim 13, wherein the treatment polymer comprises polyphosphoric acid.

15. The composition of claim 1, wherein the composition is anhydrous or substantially free of water.

16. The composition of claim 1, wherein the polymer comprises about 1 wt. % to about 50 wt. % of the styrene and about 1 wt. % to about 90 wt. % of the propylene.

17. The composition of claim 1, wherein the carrier solvent comprises a paraffin oil.

18. The composition of claim 1, wherein the composition does not comprise elemental sulfur or a sulfur-containing crosslinking agent.

19. A composition for scavenging hydrogen sulfide from a stream, comprising:

(a) a suspension of a metal component;

(b) a carrier solvent; and (c) a polymer comprising styrene, propylene and ethylene; wherein the polymer does not comprise elemental sulfur or a sulfur-containing crosslinking agent.

20. The composition of claim 19, wherein the composition comprises from about 10 wt. % to about 70 wt. % of the metal component, about 30 wt. % to about 90 wt. % of the carrier solvent, and about 0.1 wt. % to about 10 wt. % of the polymer.

* * * * *